US008241080B2

(12) United States Patent
Ichikawa et al.

(10) Patent No.: US 8,241,080 B2
(45) Date of Patent: Aug. 14, 2012

(54) COVER STRUCTURE FOR OUTBOARD ENGINE UNIT

(75) Inventors: Akiko Ichikawa, Wako (JP); Koji Sakamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 166 days.

(21) Appl. No.: 12/775,005

(22) Filed: May 6, 2010

(65) Prior Publication Data

US 2010/0285704 A1 Nov. 11, 2010

(30) Foreign Application Priority Data

May 7, 2009 (JP) ..... 2009-113065

(51) Int. Cl.
*B63H 20/32* (2006.01)

(52) U.S. Cl. ..... 440/76; 440/52

(58) Field of Classification Search ..... 440/52, 440/76, 77; 123/195 P
See application file for complete search history.

(56) References Cited

U.S. PATENT DOCUMENTS

| | | | | |
|---|---|---|---|---|
| 2,740,368 | A * | 4/1956 | Irgens et al. | 440/52 |
| 4,708,673 | A * | 11/1987 | Dunham et al. | 440/77 |
| 5,407,372 | A * | 4/1995 | Mondek et al. | 440/52 |
| 5,921,827 | A | 7/1999 | Ichihashi | |
| 6,758,706 | B2 * | 7/2004 | Ogino | 440/77 |
| 6,910,929 | B2 * | 6/2005 | Yasuda et al. | 440/77 |
| 7,841,600 | B2 | 11/2010 | Kitsu et al. | |

FOREIGN PATENT DOCUMENTS

JP 10-175594 6/1998

* cited by examiner

*Primary Examiner* — Edwin Swinehart
(74) *Attorney, Agent, or Firm* — Rankin, Hill & Clark LLP

(57) ABSTRACT

An outboard engine unit having a cover halved into two. An undercover is made of a resin and halved into a left resin half and a right resin half. A lower mount cover is made of a resin and halved into a left resin half and a right resin half. The resin halves are formed so that when they are mated together, a gap is defined at a connection therebetween on a rear face side of the outboard engine unit. An elastic rubber member is filled in the gap.

1 Claim, 6 Drawing Sheets

COVER STRUCTURE FOR OUTBOARD ENGINE UNIT

FIELD OF THE INVENTION

The present invention relates generally to a cover structure for an outboard engine unit and, more particularly, to an outboard engine unit having an undercover and a lower mount cover disposed between an engine cover and a gear case.

BACKGROUND OF THE INVENTION

An outboard engine unit is disclosed in, e.g., Japanese Patent Application Laid-Open Publication No. 10-175594 (JP 10-175594 A).

FIG. 6 hereof shows the outboard engine unit disclosed in JP 10-175594 A. Referring to FIG. 6, a cover for the outboard engine unit 200 disclosed in JP 10-175594 A has an upper cover 201 for covering an engine, a middle cover 202 disposed below the upper cover 201, a lower cover 203 disposed below the middle cover 202, and a gear case 205 disposed below the lower cover 203.

The middle cover 202 covers a lower portion of the engine. The lower cover 203 covers a drive shaft connected to a crankshaft of the engine. The gear case 205 covers a gear mechanism connected to the drive shaft. A propeller 204 is connected to the gear mechanism and is rotated via the drive shaft by the driving of the engine.

FIGS. 7A and 7B show in simplified form the structure of the middle cover 202 and the lower cover 203 for the outboard engine unit shown in FIG. 6.

In FIG. 7A, the middle cover 202 is configured so as to be divided in two on the left and right sides to form a left middle cover 206 and a right middle cover 207. The lower cover 203 is similarly configured so as to be divided in two on the left and right sides to form a left lower cover 208 and a right lower cover 209.

A very small gap 211 is formed between the cover 206 and the cover 207 when the left middle cover 206 and the right middle cover 207, as well as the left lower cover 208 and the right lower cover 209, are joined together in the cover for the outboard engine unit disclosed in JP 10-175594, as shown in FIG. 7B. In order to remove the gap 211, the end face 212 of the right middle cover 207 is trimmed to flatten the end face 212, but the edging requires time and effort. When time and effort are required for the edging, the result is that the outboard engine unit is assembled less efficiently.

SUMMARY OF THE INVENTION

It is therefore an object of the present invention to provide an outboard engine unit having a cover halved into right and left halves that can be assembled efficiently.

According to an aspect of the present invention, there is provided an outboard engine unit which comprises: an engine cover provided at an upper portion of the outboard engine unit; an undercover disposed below the engine cover; a lower mount cover disposed below the undercover; and a gear case disposed below the lower mount cover; wherein at least one of the undercover and the lower mount cover is made of a resin and halved into two halves, the resin halves being formed such that when the resin halves are mated together, a gap is defined at a connection therebetween on a rear face side of the outboard engine unit, the gap being filled with an elastic member.

With this arrangement, dimensional errors present in the resin halves can be absorbed by the elastic member. Accordingly, it becomes possible to provide an outboard engine unit wherein right and left resin halves can be assembled efficiently, and wherein a cover halved into left and right halves can also be assembled efficiently.

Preferably, the elastic member comprises a base having a width larger than that of the gap, a pair of legs extending from the base and designed for insertion into the gap, and grooves provided to the legs so as to accommodate the resin halves therein. Accordingly, the left and right resin halves fit into the two grooves when the elastic member is attached to the left and right resin halves. Therefore, it is possible to reliably attach the elastic member to the left and right resin halves.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

In the embodiment of the present invention described below, an elastic member is described as a rubber member.

Figure 1:
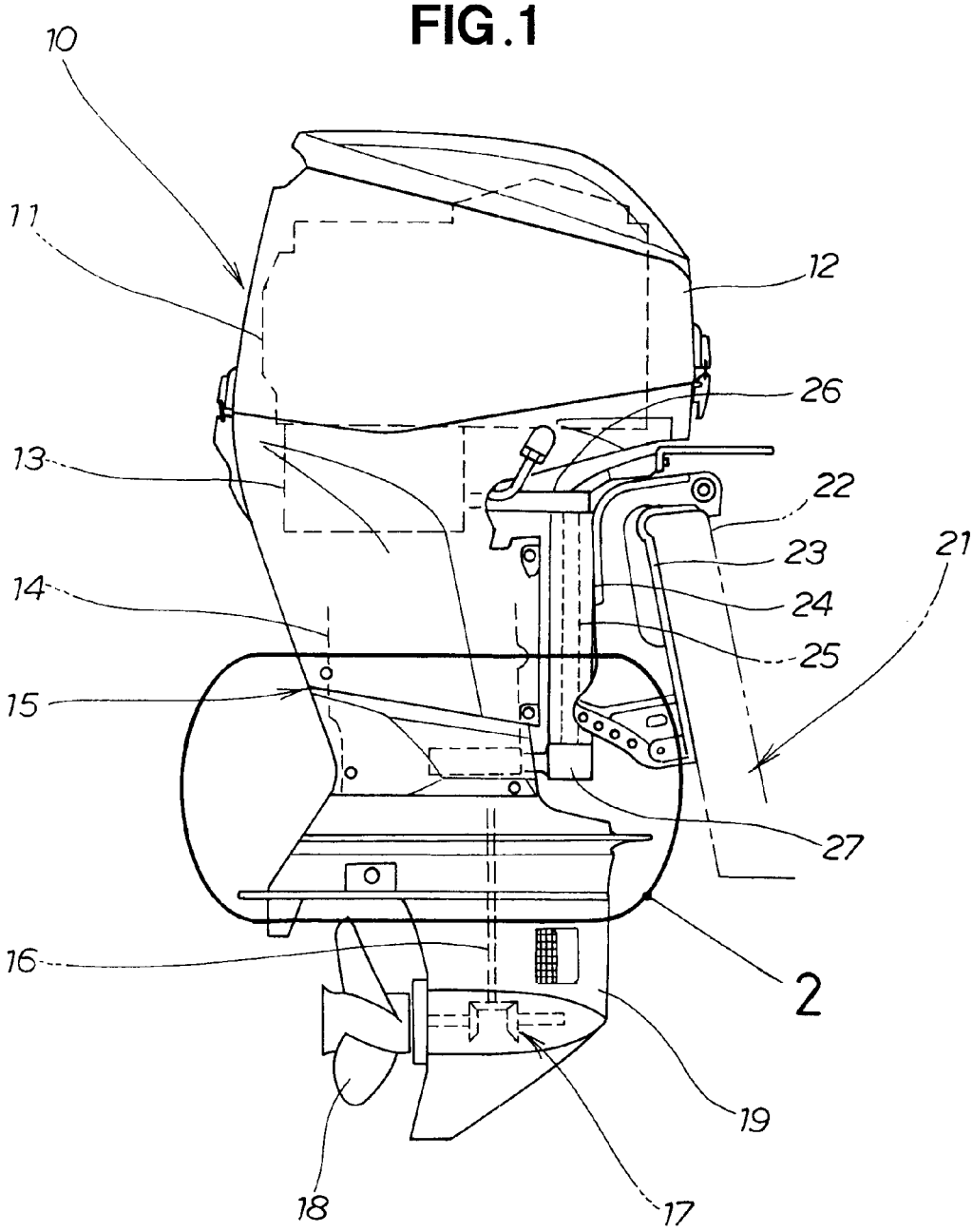
FIG. 1 is a side view of an outboard engine unit according to the present invention.

In FIG. 1, an outboard engine unit 10 has an engine cover 12 for covering an engine 11, a downwardly extending middle cover 15 connected to a lower end of the engine cover 12, and a gear case 19 connected to a lower end of the middle cover 15.

The middle cover 15 covers a lower portion of the engine 11, a mount case 13, and an inner case 14. The gear case 19 covers a drive shaft 16 and a gear mechanism 17 connected to a crankshaft of the engine 11. A propeller 18 is rotated via the drive shaft 16 and the gear mechanism 17 by the driving of the engine 11.

The outboard engine unit 10 has a stern bracket 23, and the stern bracket 23 is attached to a back end 22 of a boat or other waterborne vehicle 21. A swivel case 24 is rotatably attached to the stern bracket 23. A swivel shaft 25 is mounted vertically inside the swivel case 24. A mounting frame 26 extends from an upper end of the swivel case 24 toward a back side of the outboard engine unit 10 and supports the mount case 13. A lower mount center housing 27 is connected to a lower end of the swivel shaft 25 and extends toward a back side of the outboard engine unit 10 to support the inner case 14.

Figure 2:
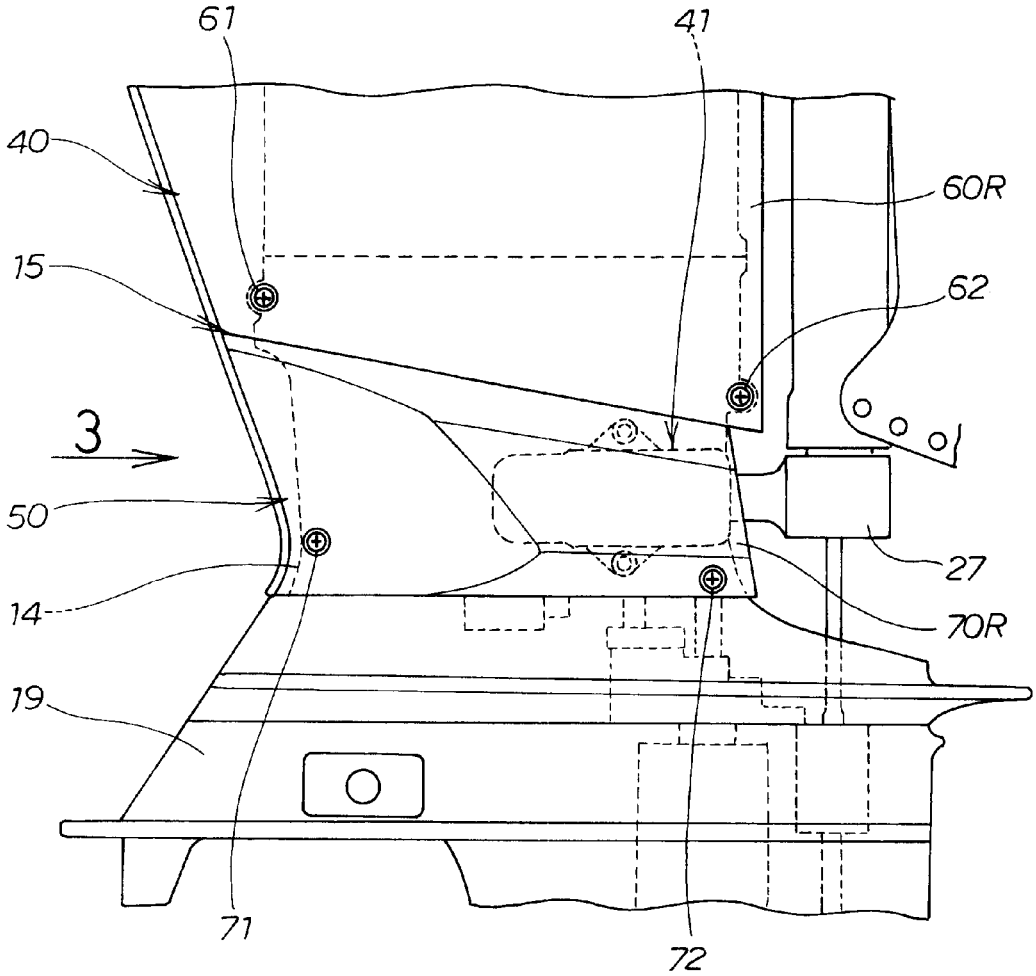
FIG. 2 is an enlarged view showing region 2 of FIG. 1.

As shown in FIG. 2, the middle cover 15 includes an undercover 40 disposed on a lower side of the engine cover 12 (FIG. 1), and a lower mount cover 50 disposed between the undercover 40 and the gear case 19.

The undercover 40 covers a lower part of the engine 11 (FIG. 1) and the mount case 13 (FIG. 1). A lower mount cover 50 covers a lower mount section 41 attached to the inner case 14.

A first right resin half 60R is a resin half for the undercover 40 and is attached to the inner case 14 by threaded components 61, 62. A second right resin half 70R is a resin half for the lower mount cover 50 and is attached to the inner case 14 by threaded components 71, 72.

Figure 3:
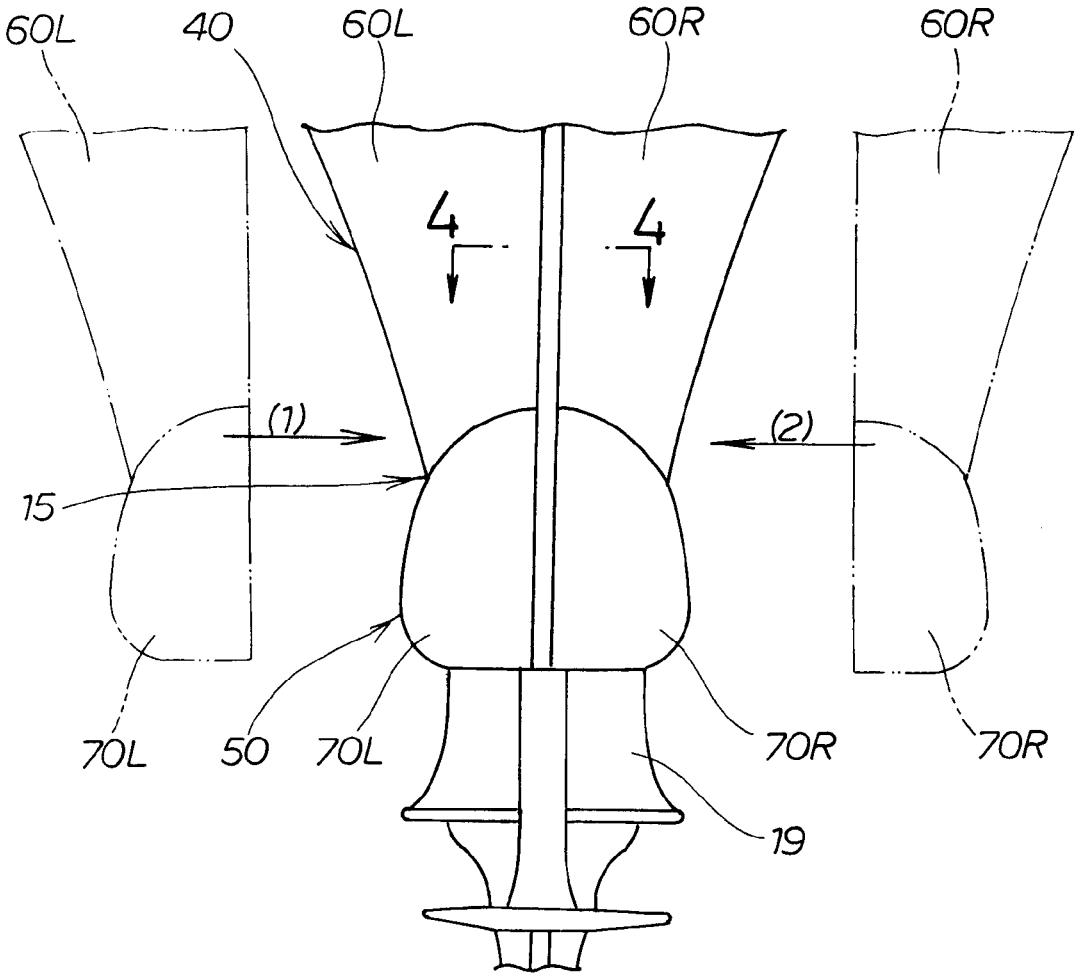
FIG. 3 is a view taken along arrow 3 of FIG. 2.

Turning now to FIG. 3, the undercover 40 is halved into two, namely, a first left resin half 60L and a first right resin half 60R, as shown by imaginary lines. The lower mount cover 50 is halved into two, namely, a second left resin half 70L and a second right resin half 70R, as shown by imaginary lines.

The undercover 40 and the lower mount cover 50 are assembled by placing the first left resin half 60L and the second left resin half 70L shown by the imaginary lines, as well as the first right resin half 60R and the second right resin half 70R shown by the imaginary lines, opposite each other as shown by arrows (1) and (2), and combining together the first and second left resin halves 60L, 70L and the first and second right resin halves 60R, 70R.

Figure 4:
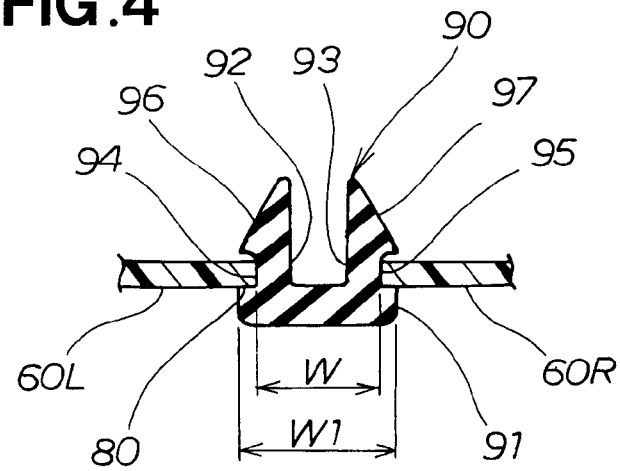
FIG. 4 is an enlarged cross-sectional view taken along line 4-4 of FIG. 3.

As shown in FIG. 4, the first left resin half 60L and the first right resin half 60R are formed short so that a gap W is present in a connection 80 at a rear face of the outboard engine unit. A rubber member 90 is embedded in the gap W. The second left resin half 70L (FIG. 3) and the second right resin half 70R (FIG. 3) are similarly formed so that a gap W is present in the connection 80 at the rear face of the outboard engine unit 10.

The rubber member 90 has a base 91 of a width W1 larger than the gap W, a pair of legs 92, 93 extending from the base 91 toward the inside of the outboard engine unit 10 in order to be inserted into the gap W, and two grooves 94, 95 provided to the legs 92, 93, with the first left resin half 60L and the first right resin half 60R being inserted into the grooves 94, 95. A tapered surface 96 is provided to the outer surface of the leg 92, and a tapered surface 97 is provided to the outer surface of the leg 93.

Because the pair of grooves 94, 95 is provided to the rubber member 90, the pair of grooves 94, 95 fits with the first left resin half 60L, the first right resin half 60R, the second left resin half 70L (FIG. 3), and the second right resin half 70R (FIG. 3) when the rubber member 90 is attached to the undercover 40 (FIG. 3) and the lower mount cover 50 (FIG. 3). The rubber member 90 can be reliably attached to the left-hand resin half 60L and the right resin half 70R because the left- and right resin halves 60L, 60R fit into the pair of grooves 94, 95.

Figure 5A:
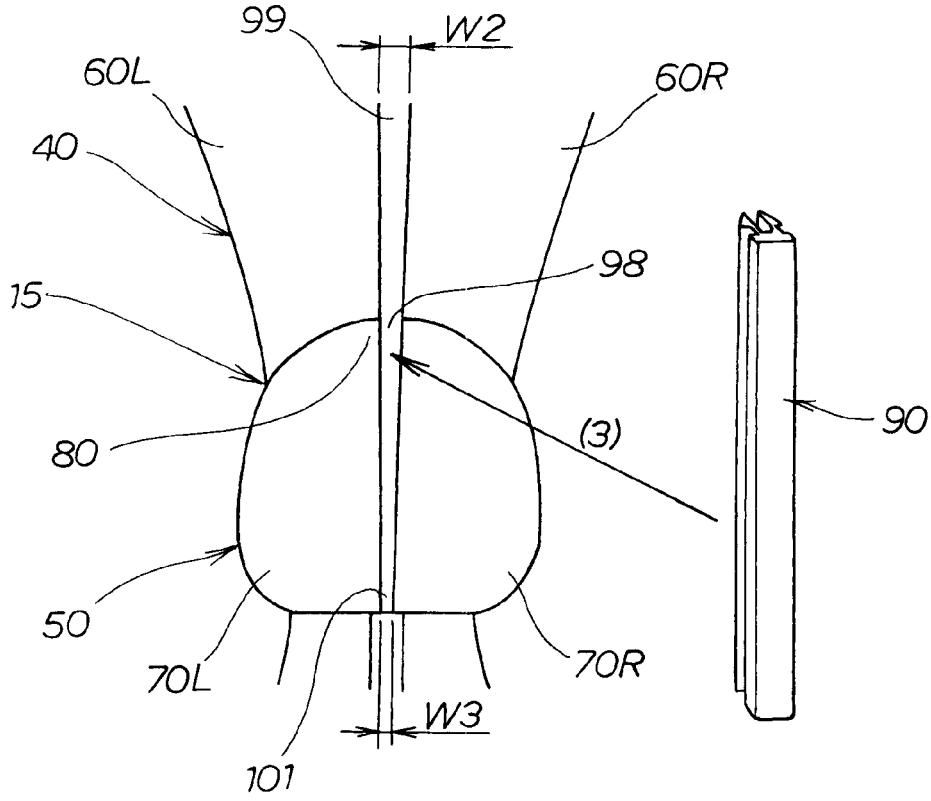
FIGS. 5A to 5C are views showing a manner in which a rubber member is filled in a gap formed upon assemblage of right and left resin halves.

A shown in FIG. 5A, the rubber member 90 fits into the gap 98 of the integrated undercover 40 and lower mount cover 50 along arrow (3).

Letting the width of an upper gap 99 formed by the first left resin half 60L and the first right resin half 60R be W2, and the width of a lower gap 101 formed by the second left resin half 70L and the second right resin half 70R be W3, the magnitude relationship of the two widths can be expressed as W2>W3.

Figure 5B:
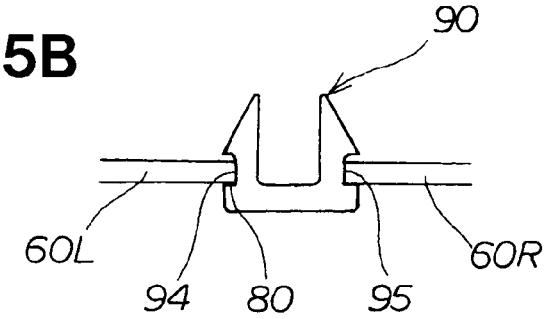

FIG. 5B corresponds to a cross-sectional view of the first left resin half 60L and the first right resin half 60R around the upper gap 99. The first left resin half 60L fits into the groove 94 on the rubber member 90, and the first right resin half 60R fits into the groove 95 on the rubber member 90.

Figure 5C:
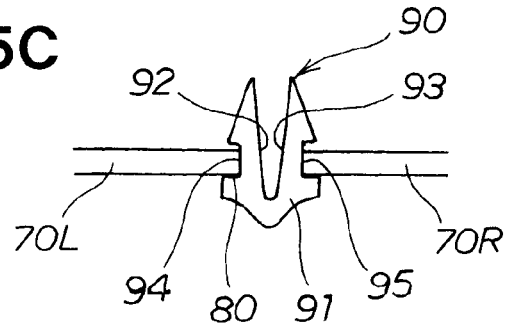
Figure 6:
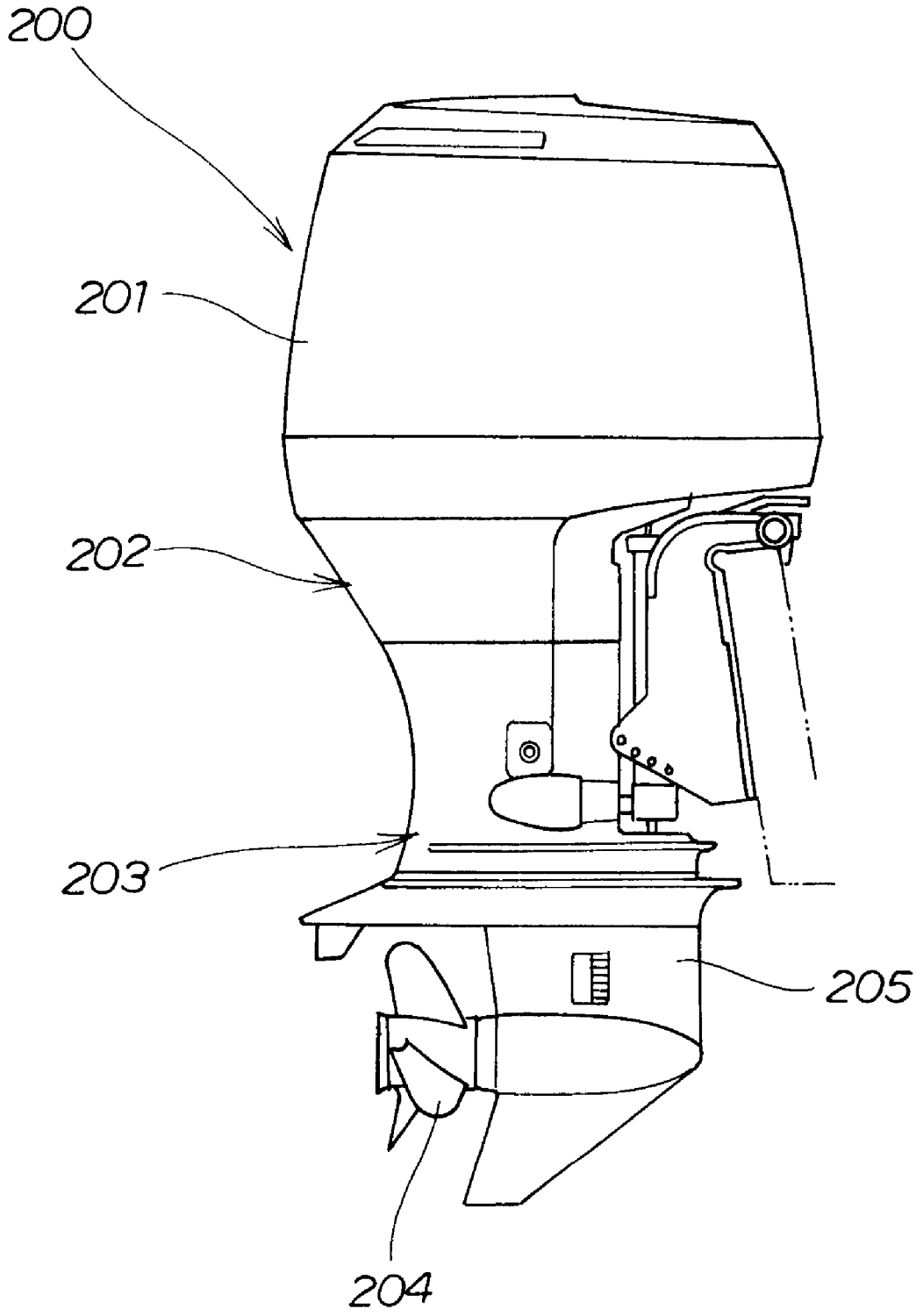
FIG.6 (PRIOR ART)
FIG. 6 is a view showing a conventional outboard engine unit.
Figure 7A:
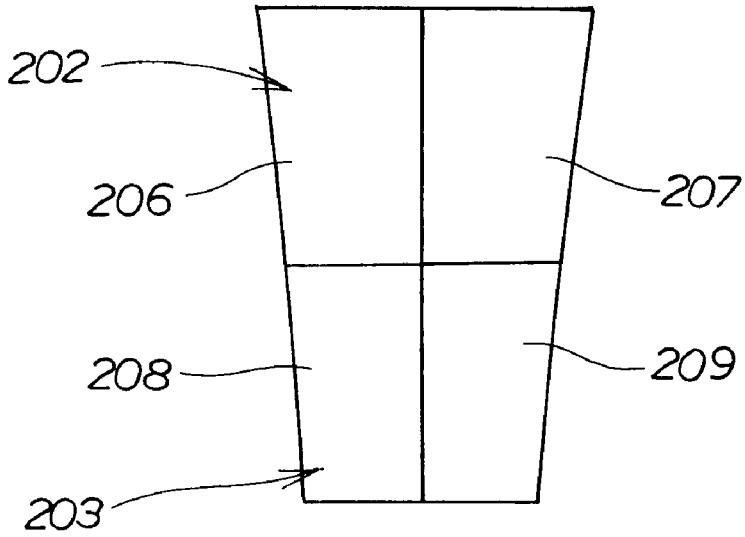
FIG.7A (PRIOR ART)
FIGS. 7A and 7B are schematic views showing a manner in which a middle cover and a lower cover of FIG. 6 are divided into two on the left and right sides.
Figure 7B:
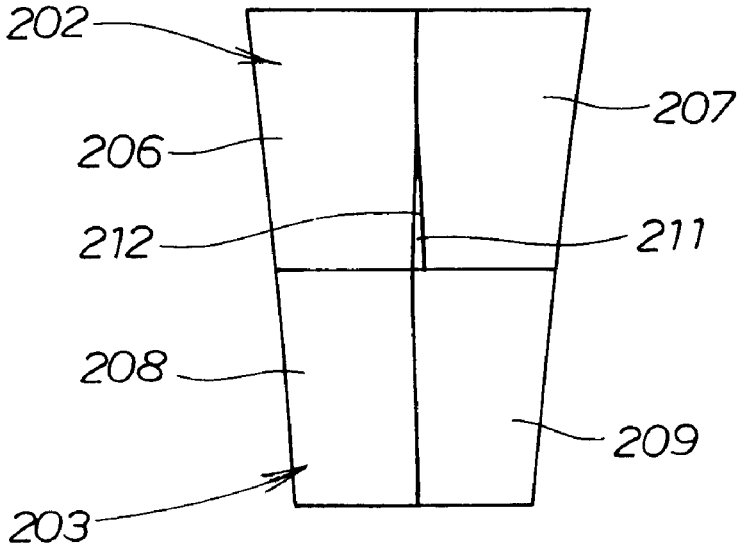
FIG.7B (PRIOR ART)

FIG. 5C corresponds to a cross-sectional view of the second left resin half 70L and the second right resin half 70R around the lower groove 101. The second left resin half 70L fits into the groove 94 on the rubber member 90, and the second right resin half 70R fits into the groove 95 on the rubber member 90. Because the width W3 of the lower gap 101 is smaller than the width W2 of the upper gap 99, the rubber member 90 undergoes deformation so that the leg 92 and the leg 93 come into contact with each other, and the base 91 is crushed.

In the outboard engine unit 10 (FIG. 1), a rear face connection 80 constructed by the left resin half 60L and the right resin half 60R, as well as the rear face connection 80 constructed by the left resin half 70L and the right resin half 70R, are formed short so that a gap W (FIG. 4) can be obtained, and the rubber member 90 can be embedded in the gap W. Therefore, dimensional errors present in the resin halves 60L, 60R, 70L, 70R can be absorbed by the rubber member 90.

Therefore, it is possible to assemble the first left resin half 60L and the first right resin half 60R, as well as the second left resin half 70L and the second right resin half 70R, with high efficiency. Accordingly, it is possible to provide an outboard engine unit in which a cover divided into left and right halves can be assembled efficiently.

In the above-described embodiment, both the undercover and the lower mount cover according to the present invention are divided into left and right halves, but only the undercover or only the lower mount cover may be divided into two left and right halves.

Although, in embodiment described above, the elastic member according to the present invention was described as a rubber member, the elastic member may also be a soft resin member or a sponge member.

Obviously, various minor changes and modifications of the present invention are possible in light of the above teaching. It is therefore to be understood that within the scope of the appended claims the invention may be practiced otherwise than as specifically described.

What is claimed is:

1. An outboard engine unit comprising:

an outboard engine;

an engine cover provided at an upper portion of the outboard engine;

an undercover disposed below the engine cover;

a lower mount cover disposed below the undercover; and a gear case disposed below the lower mount cover;

wherein at least one of the undercover and the lower mount cover is made of a resin and halved into two halves, the resin halves being formed such that when the resin halves are mounted to the outboard engine, a gap is defined at a connection therebetween on a rear face side of the outboard engine unit, the gap being filled with an elastic member, and wherein the elastic member comprises a base having a width larger than that of the gap, a pair of legs extending from the base and designed for insertion into the gap, and grooves provided to the legs so as to accommodate the resin halves therein.

* * * * *